US009062640B2

(12) United States Patent
Yamamoto et al.

(10) Patent No.: US 9,062,640 B2
(45) Date of Patent: Jun. 23, 2015

(54) FUEL RAIL AND FUEL INJECTION APPARATUS USING THE SAME

(75) Inventors: Shinsuke Yamamoto, Kariya (JP); Kingo Okada, Toyohashi (JP); Haruki Suzuki, Obu (JP)

(73) Assignee: DENSO CORPORATION, Kariya (JP)

( * ) Notice: Subject to any disclaimer, the term of this patent is extended or adjusted under 35 U.S.C. 154(b) by 291 days.

(21) Appl. No.: 13/611,276

(22) Filed: Sep. 12, 2012

(65) Prior Publication Data

US 2013/0074805 A1 Mar. 28, 2013

(30) Foreign Application Priority Data

Sep. 26, 2011 (JP) ..... 2011-209501

(51) Int. Cl.

| | |
|---|---|
| ***F02M 51/06*** | (2006.01) |
| ***F02M 51/00*** | (2006.01) |
| ***F02M 61/14*** | (2006.01) |
| ***F02M 55/02*** | (2006.01) |

(52) U.S. Cl.

CPC ..... *F02M 51/005* (2013.01); *F02M 51/06* (2013.01); *F02M 61/14* (2013.01); *F02M 55/025* (2013.01); *F02M 2200/856* (2013.01); *F02M 2200/857* (2013.01); *F02M 2200/9015* (2013.01)

(58) Field of Classification Search

CPC ... F02M 55/02; F02M 69/462; F02M 69/465; F02M 63/0225; F02M 63/0275; F02M 2200/85; F02M 2200/865

USPC ..... 123/456, 468, 469, 470

See application file for complete search history.

(56) References Cited

U.S. PATENT DOCUMENTS

| | | | | | |
|---|---|---|---|---|---|
| 5,072,710 | A | * | 12/1991 | Washizu | 123/470 |
| 5,111,794 | A | | 5/1992 | DeGrace, Jr. | |
| 5,893,351 | A | | 4/1999 | Akutagawa et al. | |
| 5,970,953 | A | * | 10/1999 | Lorraine et al. | 123/470 |
| 6,076,505 | A | * | 6/2000 | Guggenmos et al. | 123/456 |

(Continued)

FOREIGN PATENT DOCUMENTS

| | | |
|---|---|---|
| DE | 20 2011 005 464 | 9/2011 |
| EP | 0 945 611 | 9/1999 |

(Continued)

OTHER PUBLICATIONS

Office Action (2 pages) dated Sep. 13, 2013, issued in corresponding Japanese Application No. 2011-209501 and English translation (2 pages).

(Continued)

*Primary Examiner* — Thomas Moulis
(74) *Attorney, Agent, or Firm* — Nixon & Vanderhye P.C.

(57) ABSTRACT

A tubular rail body has an inlet for introducing a fuel therein from a fuel supply source. A plurality of tubular protrusion portions project from the rail body in a substantially vertical direction relative to an axial direction of the rail body, and are arranged at a predetermined interval in the axial direction. A tubular extension portion extends from each of the protrusion portions in a substantially vertical direction relative to both an axial direction of the protrusion portions and the axial direction of the rail body. The tubular extension portion is inserted into a bore which extends from an exterior of an internal combustion engine to a combustion chamber. A connecting portion is formed on an end portion of the extension portion opposite to the protrusion portion and is fluidly connected with a fuel injector inserted in the bore.

15 Claims, 5 Drawing Sheets

(56) References Cited

U.S. PATENT DOCUMENTS

| | | | | |
|---|---|---|---|---|
| 6,135,092 | A * | 10/2000 | Schaenzer et al. | 123/456 |
| 6,148,797 | A * | 11/2000 | Gmelin | 123/456 |
| 6,227,169 | B1 * | 5/2001 | Sato et al. | 123/456 |
| 6,237,571 | B1 * | 5/2001 | Harrison | 123/469 |
| 6,314,943 | B1 * | 11/2001 | Burch et al. | 123/470 |
| 6,318,341 | B1 * | 11/2001 | Gmelin et al. | 123/470 |
| 6,584,949 | B1 * | 7/2003 | Franchi et al. | 123/195 A |
| 6,598,592 | B2 * | 7/2003 | Scollard et al. | 123/470 |
| 6,666,190 | B1 * | 12/2003 | DiMaria et al. | 123/470 |
| 6,688,290 | B2 * | 2/2004 | Zehnal et al. | 123/468 |
| 6,769,407 | B2 * | 8/2004 | Cotton, III | 123/470 |
| 6,871,639 | B2 * | 3/2005 | Seymour, II | 123/476 |
| 6,874,477 | B1 * | 4/2005 | Lorraine et al. | 123/468 |
| 7,086,384 | B2 * | 8/2006 | Lee et al. | 123/468 |
| 7,104,257 | B2 * | 9/2006 | Kawamoto et al. | 123/470 |
| 7,213,578 | B2 * | 5/2007 | Oguma | 123/470 |
| 7,273,037 | B2 * | 9/2007 | Kondo | 123/456 |
| 7,406,946 | B1 | 8/2008 | Watanabe et al. | |
| 7,516,735 | B1 * | 4/2009 | Doherty et al. | 123/468 |
| 7,765,984 | B2 * | 8/2010 | Fuerst et al. | 123/456 |
| 8,074,624 | B2 | 12/2011 | Hohkita et al. | |
| 8,313,125 | B2 * | 11/2012 | Giorgetti et al. | 285/305 |
| 8,398,328 | B2 * | 3/2013 | Marc et al. | 403/166 |
| 2004/0000292 | A1 * | 1/2004 | Bodenhausen et al. | 123/456 |
| 2009/0179421 | A1 * | 7/2009 | Stieler et al. | 285/148.19 |
| 2010/0275883 | A1 | 11/2010 | Hohkita et al. | |
| 2013/0233280 | A1 * | 9/2013 | Becker | 123/470 |

FOREIGN PATENT DOCUMENTS

| | | |
|---|---|---|
| EP | 1 028 250 | 8/2000 |
| EP | 1460264 A1 | 9/2004 |
| JP | 61-029060 | 2/1986 |
| JP | 2006-161727 | 6/2006 |

OTHER PUBLICATIONS

Office Action (2 pages) dated Sep. 9, 2014, issued in corresponding Japanese Application No. 2011-209501 and English translation (2 pages).

Office Action (7 pages) dated May 6, 2014, issued in corresponding Chinese Application No. 201210310957.7 and English translation (8 pages).

Office Action (2 pages) dated May 1, 2014, issued in corresponding Japanese Application No. 2011-209501 and English translation (3 pages).

Office Action issued in corresponding Chinese Patent Application No. 201210310957.7 dated Jan. 19, 2015 (with translation).

* cited by examiner

FUEL RAIL AND FUEL INJECTION APPARATUS USING THE SAME

CROSS-REFERENCE TO RELATED APPLICATION

This application is based on Japanese Patent Application No. 2011-209501 filed on Sep. 26, 2011, the disclosure of which is incorporated herein by reference.

1. Technical Field

The present disclosure relates to a fuel rail and a fuel injection apparatus using the same.

2. Background

Conventionally, it is known that a fuel rail distributes fuel to a plurality of fuel injectors which inject fuel to combustion chambers of an internal combustion engine. For example, US-2010/0275883A1 discloses that a fuel rail is provided in a side direction of a cylinder head of an internal combustion engine. In the internal combustion engine, a first end portion of each fuel injector is inserted into a bore, which is formed obliquely in a cylinder head, and a second end portion of each fuel injector is connected with a connecting portion of the fuel rail. The fuel is injected into the combustion chambers from the fuel injectors which are provided obliquely upward relative to the combustion chambers. This internal combustion engine is referred to as a side-injection engine. In this side-injection engine, an axial length of the bore is relatively short. Therefore, in the fuel rail according to US-2010/0275883A1, a length of the connecting portions of the fuel rail is relatively short. The connecting portion is tubular shaped and projects from the rail body of the fuel rail in a vertical direction relative to an axial direction of the rail body. Besides, a plurality of the connecting portions is provided in a predetermined interval along the axial direction of the rail body.

In addition to the side-injection engine, there is a center-injection engine. In the center-injection engine, a fuel injector is provided at a center of a top of the combustion chambers, and fuel is injected into the combustion chambers vertically. In this case, the bore, which the fuel injector is inserted into, is formed to extend in a vertical direction of the cylinder head. Usually, since the vertical direction size of the cylinder head of the center-injection engine is large, an axial length of the bore, which the fuel injector is inserted into, is formed long. Thus, when the fuel rail according to US-2010/0275883A1 is provided in the center-injection engine, the connecting portion is necessary to be formed long in its axial direction.

However, in a case where the fuel rail is provided in a center-injection engine in such a manner that a connecting portion is formed long, when an ignition plug is provided between the bores formed in an axial direction of the fuel rail (front-back direction), it is likely that the ignition plug and the rail body interfere with each other. When the ignition plug and the rail body interfere with each other, the rail body can not be arranged at an extremely near position to the cylinder head. Thus, a part of the fuel rail (the rail body) is arranged far away from the cylinder head.

On the other hand, when the rail body is arranged at an extremely near position to the cylinder head, the ignition plug can be arranged in the vertical direction relative to the axial direction of the rail body (left-right direction). However, when ignition plugs are arranged in left-right direction of the rail body, the size of the cylinder head in left-right direction may increase.

SUMMARY

It is an object of the present disclosure to provide a fuel rail and a fuel injection apparatus using the same in order to restrict an interference with other members, which are arranged in an internal combustion engine.

In the present disclosure, a fuel rail is mounted on an internal combustion engine along with a plurality of fuel injectors injecting a fuel into combustion chambers of the internal combustion engine and distributes the fuel towards the fuel injectors from a fuel supply source. The fuel rail includes a rail body, protrusion portions, an extension portion, and a connecting portion. The rail body, which is tubular shaped, has an inlet for introducing the fuel therein from the fuel supply source. A plurality of tubular protrusion portions project from the rail body in a substantially vertical direction relative to the axial direction of the rail body, and are arranged at a predetermined interval in the axial direction of the rail body. The tubular extension portion extends from each of the protrusion portions in a substantially vertical direction relative to both an axial direction of the protrusion portions and the axial direction of the rail body. The tubular extension portion is inserted into a bore which extend from an exterior of the internal combustion engine to the combustion chamber. The connecting portion is formed on an end portion of each extension portion opposite to the protrusion portion. The connecting portion is fluidly connected with each of the fuel injectors inserted in the bore.

In the present disclosure, since the extension portions are connected with the fuel body through the protrusion portions, when the fuel rail is mounted on the internal combustion engine, the rail body is arranged at a position offset by a distance, which corresponds to the length of each protrusion portion from each bore in a plane direction. Thus, a predetermined size of spaces can be ensured between pluralities of protrusion portions. Thus, it is possible to restrict an interference of the rail body and other members even though the other members, such as ignition plugs, are provided in front-back direction of the internal combustion engine. Since it is possible to restrict an interference of the rail body and other members, it is possible to avoid that a part of the fuel rail projects far away from the cylinder head.

In addition, since it is possible to arrange the ignition plugs between the bores formed in front-back direction of the internal combustion engine, the size of left-right direction of the internal combustion engine can be decreased.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
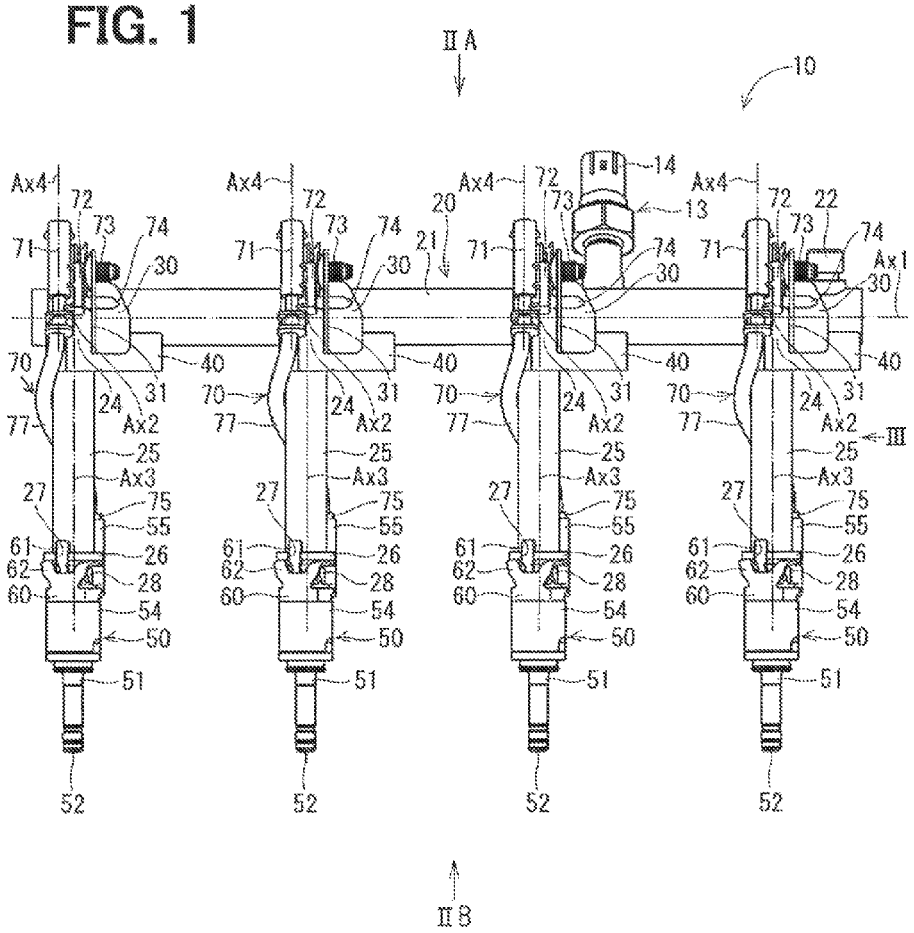
FIG. 1 is a construction diagram showing an outline of a fuel injection apparatus according to an embodiment.

Hereafter, embodiments of the present disclosure will be described. The same members and components as those in each embodiment are indicated with the same reference numerals and the same descriptions will note be reiterated.

Embodiment

A fuel rail and a fuel injection apparatus using the same are shown in FIGS. 1 to 5, according to the present embodiment.

In FIGS. 1 to 4, a fuel injection apparatus 10 includes a fuel rail 20, four fuel injectors 50 and four wire harnesses 70.

Figure 5A:
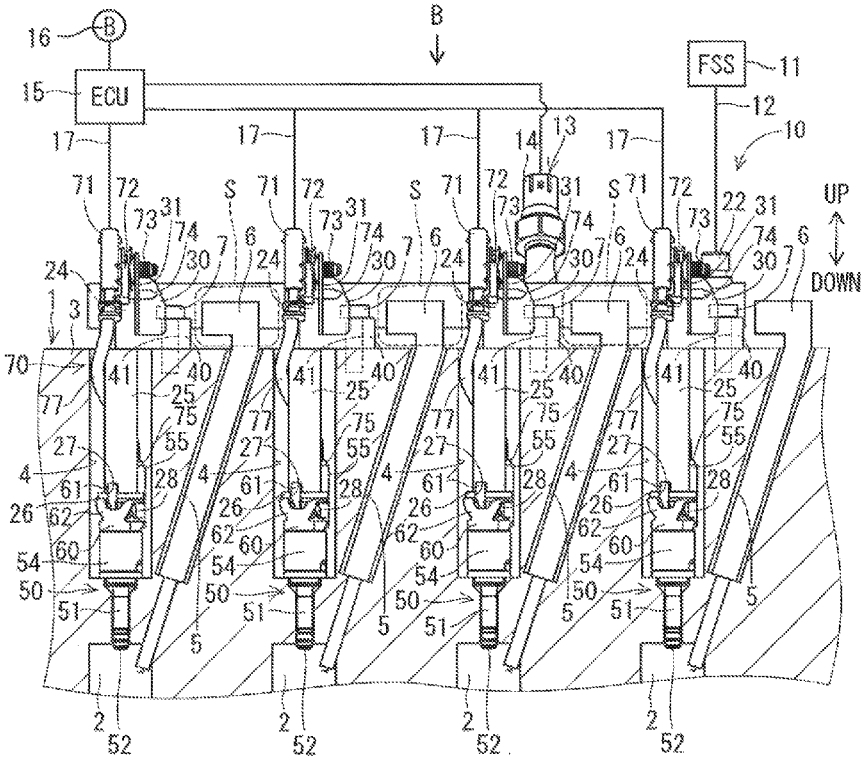
FIG. 5A is construction diagram showing an outline of a fuel injection apparatus which mounted on an internal combustion engine according to the embodiment.
Figure 5B:
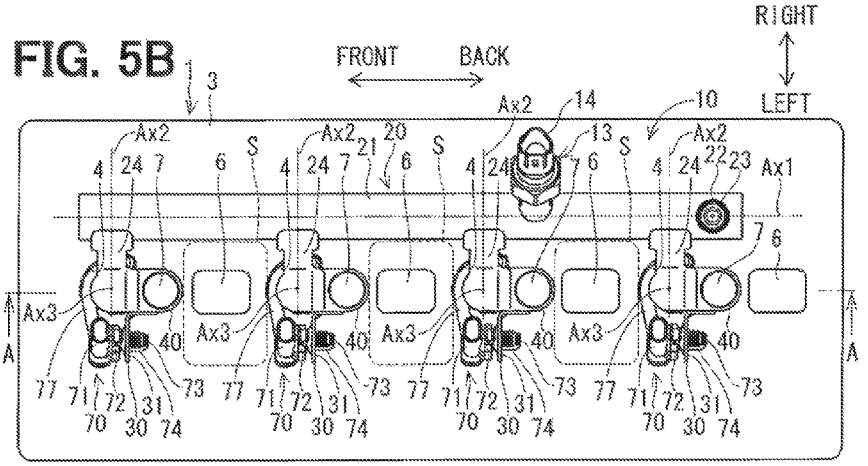
FIG. 5B is a construction diagram showing an outline of a fuel injection apparatus viewed from an arrow B of FIG. 5B.

In FIGS. 5A and 5B, the fuel rail 20 is mounted on an internal combustion engine (engine 1) along with the fuel injectors 50 which inject fuel into combustion chambers 2 of engine 1. The fuel rail 20 distributes fuel from a fuel supply source 11 to each of the fuel injectors 50.

Hereafter, for convenience, a vertical direction of FIG. 5A represents an up-down direction of the engine 1, a vertical direction of FIG. 5B represents a left-right direction of the engine 1, and a horizontal direction of FIG. 5B represents a front-back direction of the engine 1.

The fuel injectors 50 are electromagnetic direct-injecting injectors which inject high pressured fuel directly into the combustion chambers 2 of the engine 1. The engine 1, which receives the fuel injectors 50, is a four-cylinder gasoline engine. Thus, the engine 1 has four combustion chambers 2. In a cylinder head 3 of the engine 1, four bores 4 are respectively formed corresponding to four combustion chambers 2. The fuel injectors 50 are inserted into the bores 4 in order to be mounted on the engine 1. The bores 4 extend relatively long along the axial direction of the combustion chambers which is formed also in a up-down direction of the engine 1 (the cylinder head 3). The bores 4 are formed to connect an exterior of the engine 1 with the combustion chambers 2.

The depth of each bore 4 is greater than the whole axial length of each fuel injector 50. Thus, when the fuel injectors 50 are attached in the bores 4, the whole body of each fuel injector 50 is inserted in each bore 4. The fuel injectors 50 inject fuel from the vertical top of the combustion chambers 2 towards inside of the combustion chambers 2. That is, the engine 1 is a center-injection engine.

In FIGS. 5A and 5B, each of the bores 4 is aligned with each other along the front-back direction of the engine 1. Three oblique-bores 5 are formed between the bores 4, and one oblique-bore 5 is formed near the bore 4 which is at either end of the line of the four bores 4. The oblique-bores 5 are formed to connect the exterior of the engine 1 and the combustion chambers 2, and each oblique-bore 5 is formed to be oblique relative to the bore 4. Ignition plugs 6 are inserted in the oblique-bores 5. When the ignition plugs 6 are attached in the oblique-bores 5, a first end portion of each ignition plug 6 (ignition portion) projects towards a combustion chamber 2, and a second end portion of the ignition plug 6 projects towards outer space of the top of the cylinder head 3.

In FIGS. 1 to 4, the fuel rail 20 includes a rail body 21, protrusion portions 24, extension portions 25, and connecting portions 28.

The rail body 21 is formed as a hollow tubular body by metal. Both end portions of the rail body 21 are closed. A tubular fuel supply connecting portion 22 is formed on outer wall of an end portion of the rail body 21. The fuel supply connecting portion 22 has an inlet 23 which connects an inner wall of the rail body 21 with an outer wall of the rail body 21. According to FIG. 5A, a fuel supply pipe 12, which extends from a fuel supply source 11, is connected with the fuel supply connecting portion 22. Thus, the fuel is introduced from the fuel supply source 11 into the rail body 21 through the fuel supply pipe 12, the fuel supply connecting portion 22 and the inlet 23.

Each of the protrusion portions 24 is tubular shaped and projects from the rail body 21 in a substantially vertical direction relative to an axis Ax1 of the rail body 21. According to the present embodiment, four protrusion portions 24 are provided multiply at a predetermined interval in the axis Ax1 direction of the rail body 21. Besides, in each of the protrusion portions 24, a passage is formed to connect inner wall of the rail body 21 with outer of the rail body 21, so that an interior of the protrusion portions 24 communicates with an interior of the rail body 21.

Each extension portion 25 is tubular shaped and projects from an end portion of a protrusion portion 24 opposite to the rail body 21 in a substantially vertical direction relative to both the axis Ax2 direction of the protrusion portion 24 and the axis Ax1 direction of the rail body 21. An interior of the extension portion 25 communicates with an interior of the protrusion portion 24.

Each connecting portion 28 is formed on an end portion of the extension portion 25 opposite to the protrusion portion 24.

According to the present embodiment, a pressure detection portion 13 is provided in the rail body 21. The pressure detection portion 13 has a pressure sensor (not shown) which is exposed to inner space of the rail body 21. Thus, the pressure detection portion 13 can detect the pressure inside of the rail body 21. An electronic signal indicative of the pressure inside of the rail body 21, which is detected by the pressure sensor, is transmitted to an electronic control unit (ECU) 15 through a connector 14.

The ECU 15 has a microcomputer including a CPU, a ROM and a RAM. According to signals from various sensors mounted on a vehicle, the ECU 15 controls the vehicle by controlling various kinds of equipments and apparatuses mounted on a vehicle.

Figure 4A:
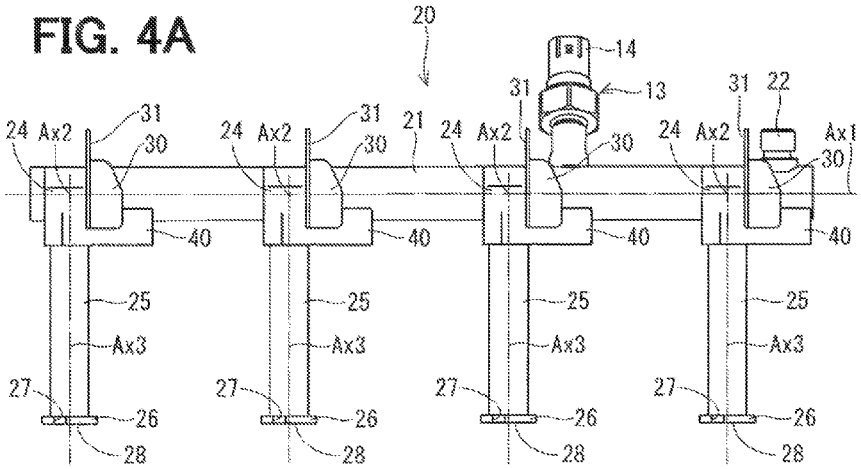
FIG. 4A is a construction diagram showing details of a fuel rail according to the embodiment.
Figure 4B:
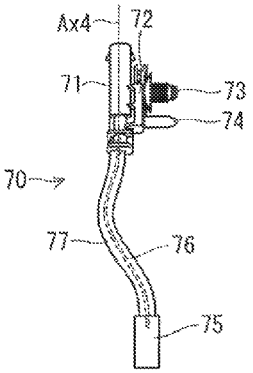
FIG. 4B is a construction diagram showing details of a wire harness according to the embodiment.
Figure 4C:
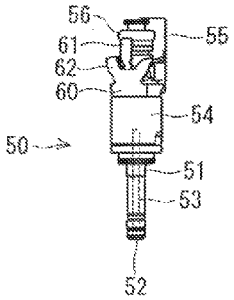
FIG. 4C is a construction diagram showing details of a fuel injector according to the embodiment.

In FIG. 4C, each fuel injector 50 includes a housing 51, a valve member 53, an electromagnetic drive portion 54; and an electronic connector 55.

The housing 51 is formed as a tubular body with a bottom by metal. An injection port 52 is formed on the bottom of the housing 51. A fuel introductory portion is formed on an end portion of the housing 51 opposite to the injection port 52. Fuel is introduced into the housing 51 through the fuel introductory portion. The valve member 53 is formed as a stick and is provided inside of the housing 51. The valve member 53 reciprocates in the housing 51 to open or close the injection port 52. The electromagnetic drive portion 54 includes a needle, a stator, and a coil, which are not shown. The needle is provided integrally with the valve member 53 on an end portion of the valve member 53 opposite to the injection port 52. The stator is provided inside the housing 51 on the side of the needle opposite to the valve member 53. The coil is provided radially outwardly from the needle and the stator. Besides, an urging member is provided between the needle and the stator in such a manner as to urge the needle and the valve member 53 toward the injection port 52.

The electronic connector 55 is formed as a tubular body by resin, and has a terminal inside. The terminal is electrically connected with the coil of the electromagnetic drive portion 54. When electrical power is supplied to the coil through the terminal of the electronic connector 55, a magnetic field is generated around the coil. Thus, magnetic circuits are formed between the needle and the stator, and a magnetic attractive force is generated between the needle and the stator. Thus, the needle and the valve member 53 are both attracted toward the stator. As a result, the valve member 53 opens. On the other hand, when the coil is deenergized, the magnetic attractive force between the needle and the stator disappears. The needle and the valve member 3 are urged toward the injection port 52 by the urging force of the urging member. As a result, the valve member 53 closes. As the description above, the valve member 53 can be controlled by controlling the electrical power which is supplied to the electromagnetic drive portion 54.

As shown in FIG. 4B, each wire harness 70 includes a first connector 71, a second connector 75, and a lead wire 76.

The first connector 71 is formed as a tubular body by resin, and has a terminal inside thereof. The second connector 75 is formed as a tubular body by resin, and has a terminal inside thereof. The lead wire 76 is electronically connected with both the terminal of the first connector 71 and the terminal of the second connector 75.

Furthermore, the wire harness 70 includes a protection tube 77, which is formed by elastic material, for covering the lead wire 76. Besides, the first connector 71 includes a joint 72. The joint 72 includes a first pin 73 and a second pin 74.

Figure 3:
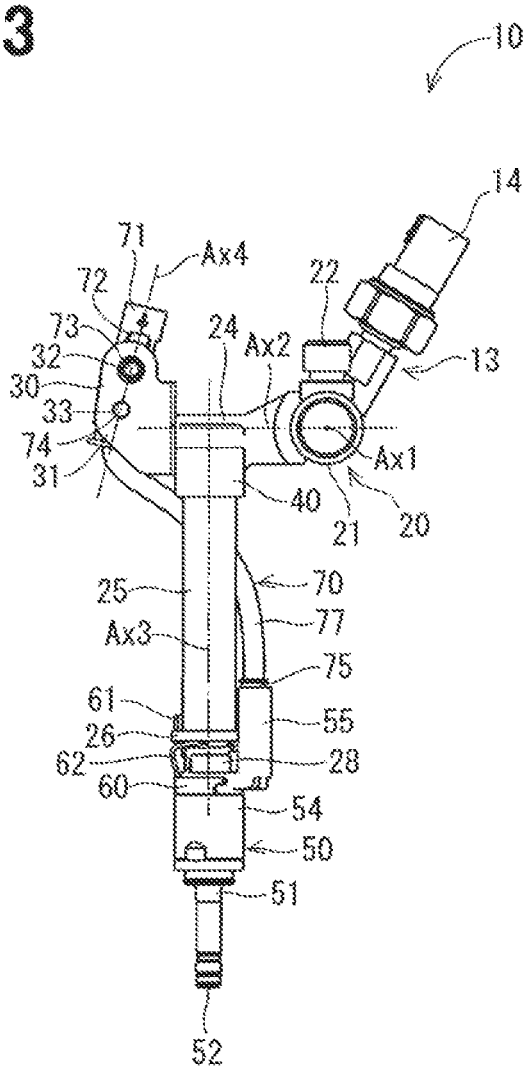
FIG. 3 is a construction diagram showing an outline of a fuel injection apparatus viewed from a direction of an arrow III of FIG. 1.

As shown in FIGS. 1 and 3, each fuel injector 50 is connected with a connecting portion 28 in such a manner that the end portion of the housing 51 (fuel introductory portion) is inserted into the connecting portion 28 of the fuel rail 20. A seal member 56 is provided on outer wall of the fuel injection member. Thus, it is fluid-tightly sealed between the outer wall of the housing 51 and the connecting portion 28.

Furthermore, a pipe collar 26 is formed as a ring, which extends from outer wall of the connecting portion 28. The fuel injector 50 includes a clip 60, which is provided in the end portion of the housing 51 opposite to the injection port 52. The clip 60 formed by metal includes a rotation-prevention portion 61 and an elastic deformation portion 62.

When the fuel injector 50 is connected with the connecting portion 28, the rotation-prevention portion 61 of the clip 60 is engaged with a groove portion 27 which is formed on the pipe collar 26. Thus, it is restricted that the fuel injector 50 rotates about the axis thereof. Besides, when the fuel injector 50 is connected with the connecting portion 28, the electronic connector 55 is placed close to the rail body 21 with respect to the axis Ax3 of the extension portion 25.

The wire harness 70 is connected with the electronic connector 55 in such a manner that the second connector 75 is inserted inside the electronic connector 55 of the fuel injector 50. Thus, the terminal of the second connector 75 is electronically connected with the terminal of the electronic connector 55.

The fuel rail 20 also includes a bracket 30, which is provided on the protrusion portion 24. The bracket 30 is fixed on the protrusion portion 24 at opposite side of the rail body 21. The bracket 30 includes a tabular attachment portion 31, which is perpendicular to the axis Ax1 of the rail body 21. A first opening 32 and a second opening 33, which penetrate the attachment portion 31 in through-thickness direction, are both formed in the attachment portion 31. As shown in FIG. 3, the first opening 32 is formed nearer to the axis Ax3 of the extension portion 25 than the second opening 33.

The first connector 71 of the wire harness 70 is mounted on the bracket 30 in such manner that the first pin 73 of the joint 72 is fit on the first opening 32 of the bracket 30 and the second pin 74 is inserted into the second opening 33. Outer wall of the first in 73 includes a plurality of circular protrusions which have inclined planes towards an end portion of the first pin 73. Thus, the first pin 73 is easy to fit on the first opening 32, but is difficult to slip out of the first opening 32.

The first connector 71 is inclined toward the rail body 21 when the first connector 71 is mounted on the bracket 30. The first connector 71 is provided in such a manner that the axis Ax4 is inclined to the axis Ax3 of the extension portion 25, as shown in FIG. 3. The connector 14 of the pressure detection portion 13 is also provided in such a manner that the axis of the connector 14 is inclined to the axis Ax3 of the extension portion 25.

Figure 2A:
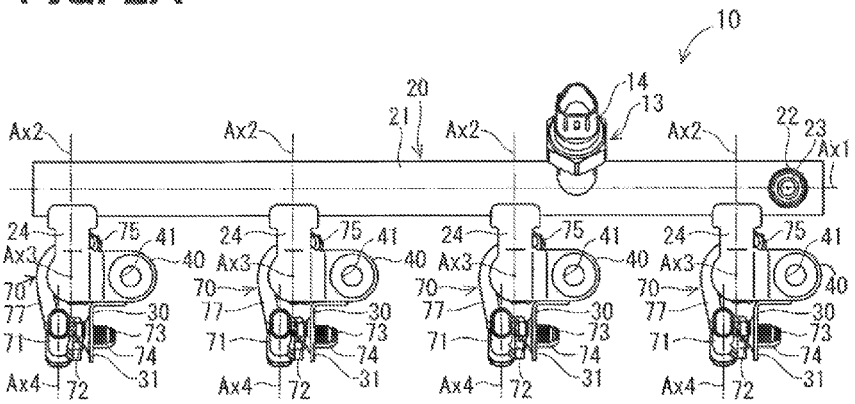
FIG. 2A is a construction diagram showing an outline of fuel injection apparatus viewed from a direction of an arrow IIA of FIG. 1.
Figure 2B:
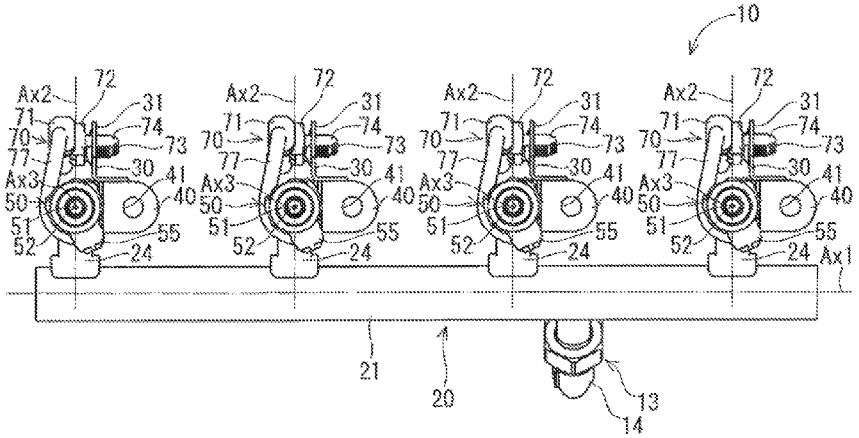
FIG. 2B is a construction diagram showing an outline of fuel injection apparatus viewed from a direction of an arrow IIB of FIG. 1.

As shown in FIGS. 1 to 3, the fuel rail 20 also includes a fixation portion 40 which is provided in an end portion of the extension portion 25 of the protrusion portion 24. The fixation portion 40 is integrally formed with the protrusion portion 24 in such a manner that the fixation portion 40 projects in a parallel direction of the axis Ax2 of the rail body 21 from the end portion of the extension portion 25 of the protrusion portion 24. A bolt hole 41, which penetrates the fixation portion 40 in a parallel direction of axis Ax3 of the extension portion 25, is formed on the fixation portion 40.

As shown in FIG. 5, the fixation portions 40 are fixed on the cylinder head 3 in such a manner that the fixation portions 40 are screwed together with the cylinder head 3 by penetrating bolts 7 through the bolt holes 41. Thus, the fuel injection apparatus 10, which includes the fuel rail 20, is mounted on the cylinder head 3. When the fuel injection apparatus 10 is mounted on the cylinder head 3, a vertical force is applied downwards to the elastic deformation portions 62 of the clips 60 of the fuel injectors 50 from the pipe collars 26 of the extension portions 25. Thus, the housings 51 of the fuel injectors 50 are pressed to stepped surfaces of the bores 4. As a result, the positions of the fuel injectors 50 are stable in the bores 4.

In the present embodiment, since the extension portions 25 are connected with the rail body 21 through the protrusion portions 24, when the fuel rail 20 (the fuel injection apparatus 10) is mounted on the cylinder head 3, the rail body 21 is arranged at a position offset by a distance, which corresponds to the length of each protrusion portion 24 from each bore 4 in a plane direction. Thus, a predetermined size of spaces S can be ensured between pluralities of protrusion portions 24. Thus, in the present embodiment, the fuel rail 20 does not interfere with the ignition plugs 6.

An end portion of the power harness which is connected with the electronic power source 16, is connected with the first connector 71 of the wire harness 70. The ECU 15, which is provided between the electronic power source 16 and the power harness 17, controls electronic force which is supplied from the electronic power source 16 to the fuel injector 50 through the power harness 17. Thus, the ECU 15 can control fuel injection from the fuel injector 50.

Besides, the ECU 15, which is connected with each ignition plug 6 through another power harness, controls electronic power which is supplied to the ignition plug 6. Thus, the ECU 15 can control the fuel ignition by the ignition plug 6. It should be noted that the power harness, which is connected with the ECU 15 and the ignition plug 6, is not shown in FIG. 5A in order to avoid the complexity of the diagram.

Next, operations of the fuel injection apparatus 10 and other apparatuses will be described.

When fuel is discharged from the fuel supply source 11, the fuel flows inside the rail body 21 through the fuel supply pipe 12 and the inlet 23. The fuel, which flows inside of the rail body 21, is distributed to four fuel injectors 50 independently through a plurality of the protrusion portions 24 and the extension portions 25 and is introduced into each housing 51 from the fuel introductory portion of each fuel injector 50. Thus, the housings 51 are filled with fuel.

In a case where the housings 51 are filed with fuel, when the ECU 15 supplies electronic power to the electromagnetic drive portion 54 of the fuel injector 50, the valve member 53 opens and fuel is injected into the combustion chamber 2 from the injection port 52. After that, when the ECU 15 terminates to supply electronic power to the electromagnetic drive portion 54, the valve member 53 closes and fuel injection from the injection port 52 is terminated.

When the ECU 15 supplies electronic power to the ignition plug 6, ignition portion of the ignition plug 6 generates sparks and fuel is ignited.

The operation of the engine 1 continues by repeating above actions of the fuel injector 50 and the ignition plug 6.

As the description above, in the present embodiment, the fuel rail 20 is mounted on the engine 1 in such a manner that the fuel rail 20 is connected with a plurality of the fuel injectors 50, which are provided on the center of the top of the combustion chambers 2 of the engine 1. That is, the engine 1, which the fuel rail is mounted on, is a center-injection internal combustion engine. Thus, the bores 4, which receive the fuel injectors 50, are formed relatively deeply. In the present embodiment, since the fuel rail 20 has extension portions 25, the fuel inside of the rail body 21 can be introduced through the extension portions 25 into deep positions of the bores 4, that is, the fuel can be distributed to the fuel injectors 50 which are provided near the combustion chambers 2.

In the present embodiment, since the extension portions 25 are connected with the rail body 21 through the protrusion portions 24, when the fuel rail 20 is mounted on the engine 1, the rail body 21 is arranged at a position offset by a distance, which corresponds to the length of each protrusion portion 24 from each bore 4 in a plane direction. Thus, a predetermined size of spaces S can be ensured between pluralities of protrusion portions 24. Thus, it is possible to restrict an interference of the rail body 21 and other members even though the other members, such as ignition plugs, are provided in front-back direction of the engine 1. Since it is possible to restrict at interference of the rail body 21 and other members, it is possible to avoid that a part of the fuel rail 20 projects far away from the cylinder head 3 of the engine 1.

In addition, since it is possible to arrange the ignition plugs 6 between the bores 4 formed in front-back direction of the engine 1, the size of left-right direction of the engine 1 can be decreased.

In the present embodiment, the fuel injection apparatus 10 includes the fuel rail 20, the fuel injector 50 and the wire harness 70. The fuel injector 50 includes the housing 51, which includes the injection port 62, the valve member 53, which opens or closes the injection port 52 by reciprocating inside the housing 51, the electromagnetic drive portion 54, which drives the valve member 53, and the electronic connector 55, which is connected with the electromagnetic drive portion 54. Besides, the housing 51 is connected with the connecting portion 28 of the fuel rail 20 and the fuel injector 50 is inserted in the bore 4 of the engine 1. The wire harness 70 includes the first connector 71, which is connected with the end portion of the power harness 17 connecting to the electronic power source 16, the second connector 75, which is connected with the electronic connector of the fuel injector 50, and the lead wire 76, which is connected with the first connector 71 and the second connector 75. The fuel injection apparatus 10 includes the fuel rail 20 above. Thus, it is possible to restrict an interference of the fuel rail 20 and other member.

In the present embodiment, the wire harness 70 is provided in such a manner that the first connector 71 is placed opposite to the protrusion portion 24 with respect to the rail body 21. Thus, it is possible to restrict an interference of the first connector 71 and other member when and after the fuel injection apparatus 10 is mounted on the engine 1, even if the ignition plugs 6 and the like are attached between the bores 4 of the engine 1.

In the present embodiment, the bracket 30 is provided on the opposite side to the rail body 21 with respect to the protrusion portion 24 of the fuel rail 20. The wire harness 70 is provided in such a manner that the first connector 71 can be mounted on the bracket 30. Thus, when the engine 1 is operating, it can be restricted that a relative position of the first connector 71 changes relative to the fuel rail 20. Thus, it can maintain a sufficient connecting condition between the first connector 71 and the power harness 17. Thus, electronic power can be stably supplied to the electromagnetic drive portion 54 of the fuel injector 50.

In first connector 71 is mounted the bracket 30, the engine 1 is operating, it can be restricted that a relative position of the first connector 71 changes relative to the second connector 75, which is connected with the electronic connector 55 of the fuel injector 50. Thus, it can be restricted that a repeated stress generates on the lead wire 76, which is connected with the first connector 71 and the second connector 75. Thus, damages of the lead wire 76 can be restricted.

In the present embodiment, the first connector 1 includes the joint 72, which can fit in the bracket 30. Thus, the first connector 71 can be mounted on the bracket 30. Thus, it is easy to attach the first connector 71 to the bracket 30, or to remove the first connector 71 from the bracket 30.

In the present embodiment, the fuel injector 50 is provided in such a manner that the electronic connector 55 is placed on the side of the rail body 21 relative to the axis Ax3 of the extension portion 25 of the fuel rail 20. Thus, a predetermined size of spaces can be ensured between pluralities of extension portions 25 in a parallel direction of the axis Ax1 of the rail body 21. Thus, it is easy to arrange other members such as the ignition plugs 6, between pluralities of extension portions 25.

In the present embodiment, the wire harness 70 is provided in such a manner that the first connector 71 is placed on the opposite side to the rail body 21 with respect to the protrusion portion 24, and the fuel injector 50 is provided in such a manner that the electronic connector 55 is placed on the side of the rail body 21 relative to the axis Ax3 of the extension portion 25 of the fuel rail 20. Thus, the first and second connectors 71, 75 are placed on a symmetrical position with respect to the axis of the extension portion 25. Thus, the lead wire 76, which is connected with the first connector 71 and the second connector 75, is deformed to twist and can be in contact with or be slidable on the extension portion 25. Further, the wire harness 70 includes the protection tube 77 for covering the lead wire 76, which is formed by elastic material. Thus, the protection tube 77 can protect the lead wire 76 from being damaged by connecting or sliding with the extension portion 25.

In the present embodiment, the first connector 71, which is formed as a tubular body, is provided in such a manner that the axis Ax4 is oblique to the axis Ax3 of the extension portion 25. Since the first connector 71 is provided on the opposite side to the rail body 21 with respect to the extension portion 24 of the fuel rail 20, the end portion of the power harness 17 of the first connector 71 is oblique toward the rail body 21.

Thus, the power harness 17, which is connected with the first connector 71, can be easily handled.

In the present embodiment, the fixation portion 40, which is integrally formed with the protrusion portion 24, is fixed on the engine 1. Thus, when the fuel rail 20 is mounted on the engine 1, the position of the extension portion 25 relative to the engine 1 is stable. Thus, it can maintain a sufficient connecting condition between the connecting portion 28 and the fuel injector 50, and it also can restrict a fuel leak from the connecting portion 28 and damages due to a conflict between the engine (the cylinder head 3) and the end portion of the fuel injector 50.

Other Embodiments

In another embodiment according to the present disclosure, a wire harness may be provided in such a manner that a first connector is placed at a position which is other than a position opposite to the rail body with respect to the extension portion.

In another embodiment according to the present disclosure, a fuel rail may not have a bracket. In this case, a first connector of a wire harness may not be fixed.

In another embodiment according to the present disclosure, the first connector may not have a fixation portion, which is fit to the bracket.

In another embodiment according to the present disclosure, a fuel injector may be provided in such a manner that an electronic connector is placed on the opposite side to a rail body with respect to an axis of an extension portion. The fuel injector also can be provided in such a manner that the electronic connector is placed on a position, which is the rail body side or other position of the opposite side to the rail body with respect to the axis of the extension portion. The wire harness may not have a protection tube, which is formed by elastic material.

In another embodiment according to the present disclosure, the first connector is provided in such a manner that axis of the first connector is parallel to the axis of the extension portion.

In another embodiment according to the present disclosure, the fixation portion, which is fixed on an internal combustion engine, may be provided integrally with the extension portion. Alternatively, the fixation may be provided integrally with both the protrusion portion and the extension portion. The fixation portion may be placed anywhere on the member, which comprises the fuel rail.

In another embodiment according to the present disclosure, the fuel rail may not have a pressure detection portion. The fuel injector may not have a clip.

In another embodiment according to the present disclosure, the extension portion may be formed as a curved or bent tubular body instead of a straight tubular body. Alternatively, the shape of the extension portion may be changed so that the fuel injector can fit the shape of the bore, which receives the fuel injector of an internal combustion engine.

In other embodiment according to the present disclosure, the number of protrusion portions, extension portions and connecting portions is not limited to four, may be provided two, three, or five or even more in a fuel rail. That is, the number of protrusion portions, extension portions and connecting portions may be changed so that this number can fit the number of combustion chambers of an internal combustion engine or the number of fuel injectors.

In the present disclosure, the fuel rail and the fuel injector are not limited to be provided on an internal combustion engine of center-injection, also may be provided on an internal combustion engine of side-injection.

Furthermore, in the present disclosure, the fuel rail and the fuel injects are not limited to be used in a gasoline engine, also may be used in a diesel engine.

As the description above, the present disclosure is not limited to the embodiment above, and may be modified in various ways without departing the scope of the present disclosure.

What is claimed is:

1. A fuel rail mounted to an internal combustion engine along with a plurality of fuel injectors injecting a fuel into combustion chambers of the internal combustion engine, the fuel rail distributing the fuel towards the fuel injectors from a fuel supply source, the fuel rail comprising:

a tubular rail body including an inlet through which the fuel is introduced therein from the fuel supply source;

a plurality of tubular protrusion portions projecting from the rail body in a substantially vertical direction relative to an axial direction of the rail body, the protrusion portions being arranged at a predetermined interval in the axial direction of the rail body;

a tubular extension portion extending from each of the protrusion portions in a substantially vertical direction relative to both an axial direction of the protrusion portions and the axial direction of the rail body, the tubular extension portion being inserted into a bore which extends from an exterior of the internal combustion engine to the combustion chamber;

a connecting portion formed on an end portion of the extension portion opposite to the protrusion portion, the connecting portion being fluidly connected with each of the fuel injectors inserted in the bore; and a bracket provided on the protrusion portion, the bracket being configured to have a wire harness supplying power to the fuel injector mounted on the bracket.

2. A fuel injection apparatus, comprising:

a tubular rail body including an inlet through which a fuel is introduced therein from a fuel supply source;

a plurality of tubular protrusion portions projecting from the rail body in a vertical direction relative to an axial direction of the rail body, the protrusion portions being arranged at a predetermined interval in the axial direction of the rail body;

a tubular extension portion extending from each of the protrusion portions in a vertical direction relative to both an axial direction of the protrusion portions and the axial direction of the rail body, the tubular extension portion being inserted into a bore which extends from an exterior of an internal combustion engine to a combustion chamber;

a fuel injector, which is inserted in the bore and is connected with a connecting portion, including a housing having an injection port, a valve member configured to reciprocate in the housing to open or close the injection port, an electromagnetic drive portion configured to drive the valve member, and an electronic connector connected with the electromagnetic drive portion;

the connecting portion being formed on an end portion of the extension portion opposite to the protrusion portion, the connecting portion being fluidly connected with each of the fuel injectors inserted in the bore;

a wire harness including a first connector connected with an end portion of a power harness which is connected with an electronic power source, a second connector connected with the electronic connector of the fuel injector, and a lead wire connecting the first connector and the second connector, and a bracket provided on the protrusion portion, the wire harness being mounted on the bracket.

3. A fuel injection apparatus according to claim 2, wherein:

the wire harness is provided in such a manner that the first connector is placed on a side opposite to the rail body with respect to the protrusion portion.

4. A fuel injection apparatus according to claim 3, wherein:

the wire harness is provided in such a manner that the first connector is mounted on the bracket.

5. A fuel injection apparatus according to claim 4, wherein:

the first connector includes a joint which can fit in the bracket.

6. A fuel injection apparatus according to claim 2, wherein:

the fuel injector is provided in such a manner that the electronic connector is placed on a side or an opposite side of the rail body with respect to an axis of the extension portion.

7. A fuel injection apparatus according to claim 3, wherein:

the fuel injector is provided in such a manner that the electronic connector is placed on a side of the rail body with respect to the axis of the extension portion; and the wire harness includes a protection tube that covers the lead wire and that is formed by an elastic material.

8. A fuel injection apparatus according to claim 2, wherein:

the first connector, which is tubular shaped, is provided in such a manner that an axis of the first connector is oblique to an axis of the extension portion.

9. A fuel injection apparatus according to claim 2, further comprising:

a fixation portion, which is fixed on the internal combustion engine, integrally formed with at least one of the protrusion portion and the extension portion.

10. A fuel rail according to claim 1, further comprising:

a fixation portion, which is fixed on the internal combustion engine, integrally formed with at least one of the protrusion portion and the extension portion.

11. A fuel rail according to claim 1, further comprising:

a bracket provided on a side opposite to the rail body with respect to the protrusion portions.

12. A fuel rail according to claim 1, wherein:

the connecting portion includes a groove portion.

13. A fuel rail according to claim 1, wherein:

the extension portion has an axial length greater than a distance between the protrusion portions adjacent to each other.

14. A fuel injection apparatus according to claim 9, wherein:

the fuel injector includes a clip provided in an end portion of the housing adjacent to the connecting portion, the clip being pressed by the housing and the connecting portion in a case where the fixation portion is fixed on the internal combustion engine so as to (i) bias the housing toward the internal combustion engine and (ii) bias the connecting portion in an axial direction of the extension portion opposite to the internal combustion engine.

15. A fuel injection apparatus according to claim 14, wherein:

the connecting portion includes a groove portion, and the clip includes a rotation prevention portion engaged with the groove portion.

* * * * *